US011400745B2

(12) United States Patent
Kitayama et al.

(10) Patent No.: US 11,400,745 B2
(45) Date of Patent: Aug. 2, 2022

(54) BOOK BINDING SYSTEM

(71) Applicant: Horizon International Inc., Takashima (JP)

(72) Inventors: Shinya Kitayama, Takashima (JP); Shigenobu Fukuda, Takashima (JP); Takakazu Hori, Takashima (JP)

(73) Assignee: Horizon International Inc., Shiga (JP)

( * ) Notice: Subject to any disclaimer, the term of this patent is extended or adjusted under 35 U.S.C. 154(b) by 0 days.

(21) Appl. No.: 16/944,933

(22) Filed: Jul. 31, 2020

(65) Prior Publication Data

US 2021/0046775 A1 Feb. 18, 2021

(30) Foreign Application Priority Data

Aug. 13, 2019 (JP) ..... JP2019-148477

(51) Int. Cl.

| | |
|---|---|
| ***B42C 19/08*** | (2006.01) |
| ***B42C 5/00*** | (2006.01) |
| ***B42C 9/00*** | (2006.01) |
| ***B42C 11/04*** | (2006.01) |
| ***B42C 19/02*** | (2006.01) |
| ***B42C 19/06*** | (2006.01) |
| ***B42C 19/00*** | (2006.01) |

(52) U.S. Cl.

CPC ..... *B42C 19/08* (2013.01); *B42C 5/00* (2013.01); *B42C 9/0006* (2013.01); *B42C 11/04* (2013.01)

(58) Field of Classification Search

CPC ..... B42C 19/08; B42C 5/00; B42C 9/0006; B42C 11/04; B42C 19/00; B42C 9/00

USPC ..... 412/9, 11, 14, 16, 19, 22, 25, 32, 33, 37

See application file for complete search history.

(56) References Cited

U.S. PATENT DOCUMENTS

2017/0066273 A1 3/2017 Altenbach et al.
2021/0008918 A1* 1/2021 Herrmann ..... G05B 19/042

FOREIGN PATENT DOCUMENTS

EP 3141398 A1 3/2017
JP 2010-274501 A 12/2010
JP 2013-169798 A 9/2013

(Continued)

OTHER PUBLICATIONS

Extended European Search Report for corresponding European Application No. 20187336.1 dated Dec. 16, 2020.

*Primary Examiner* — Justin V Lewis

(74) *Attorney, Agent, or Firm* — Renner, Otto, Boisselle & Sklar, LLP

(57) ABSTRACT

A book block supplying machine includes a reader which reads job information from an information portion printed on a book block; and a timing adjusting portion which adjusts a supply timing at which the book block is fed toward the book binding machine. A controller includes: a job information acquisition portion which acquires the job information; an upper limit processing speed acquisition portion which acquires an upper limit processing speed; a making speed decision portion which adopts and decides the making speed; a making speed instruction portion which instructs the book binding machine to make the bound material at the making speed; a timing decision portion which decides the supply timing based on the making speed, upper limit processing speed and accumulating number; and a timing instruction portion which instructs the timing adjusting portion to supply the book block at the supply timing.

9 Claims, 6 Drawing Sheets

(56) References Cited

FOREIGN PATENT DOCUMENTS

| | | | |
|---|---|---|---|
| JP | 2014-054731 | A | 3/2014 |
| WO | 2013/161048 | A | 10/2013 |
| WO | 2013/179380 | A | 12/2013 |
| WO | 2016/207977 | A | 12/2016 |

* cited by examiner

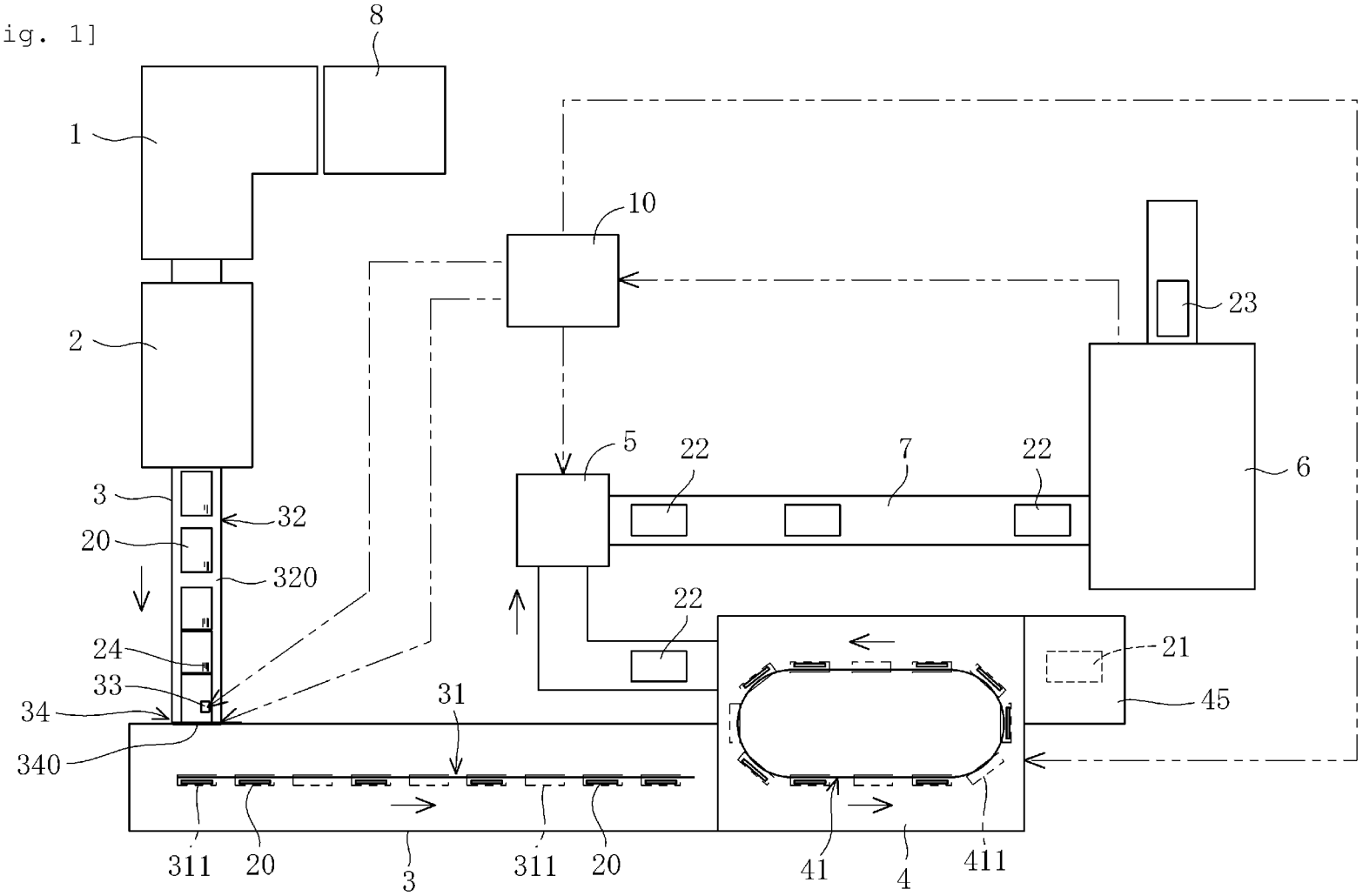
[Fig. 1]

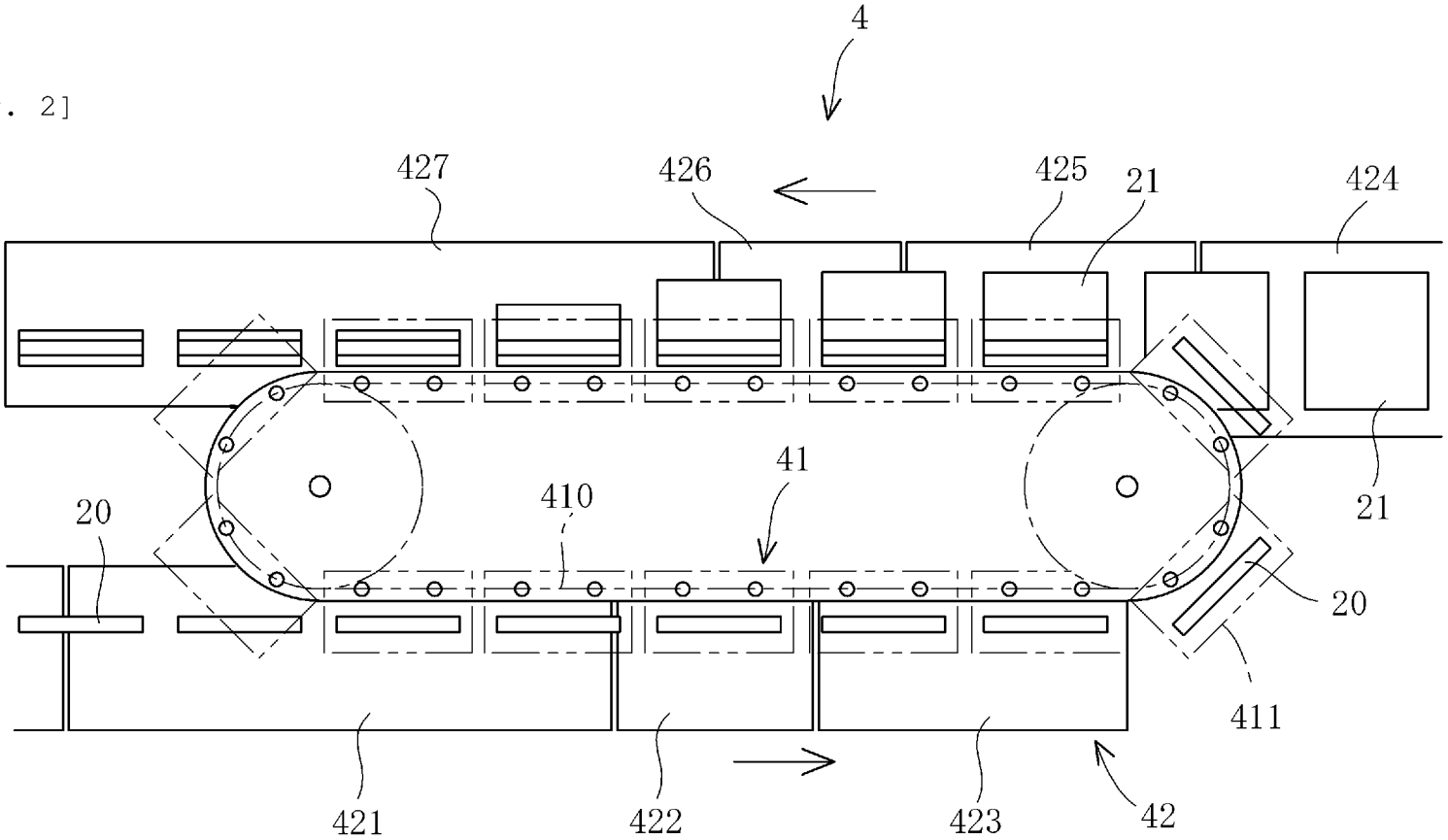
[Fig. 2]

[Fig. 3]
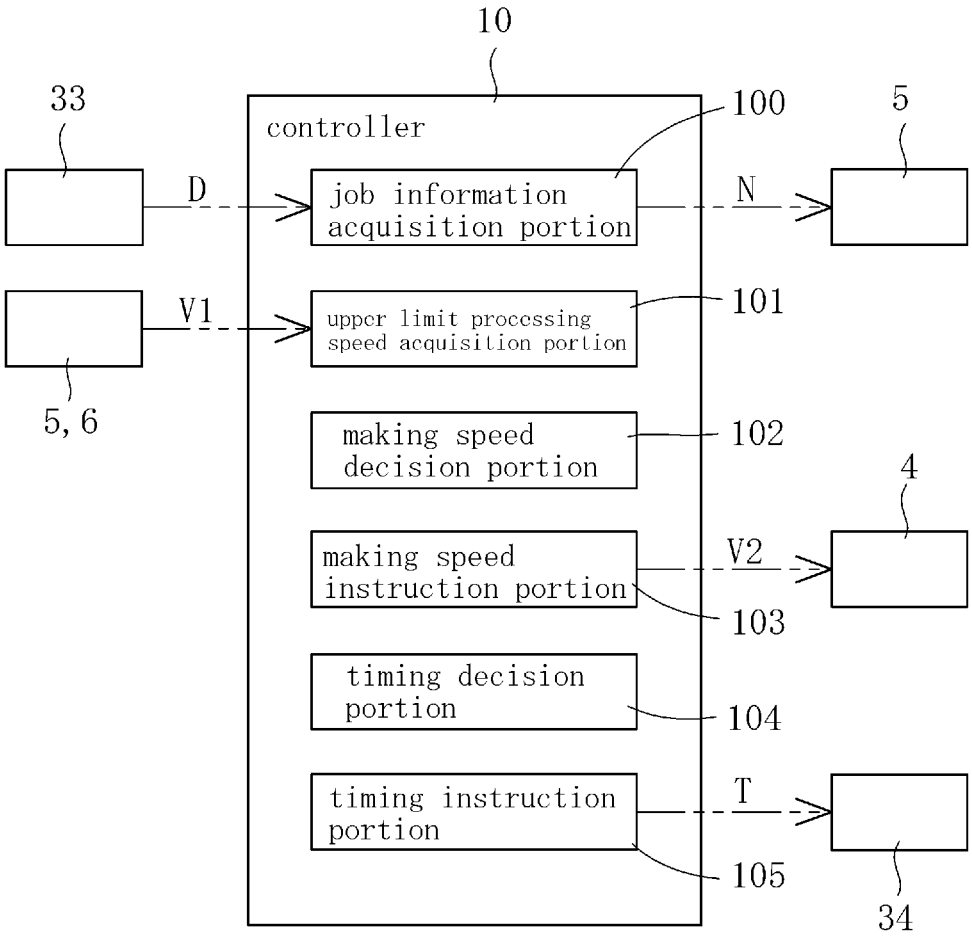

[Fig. 4]
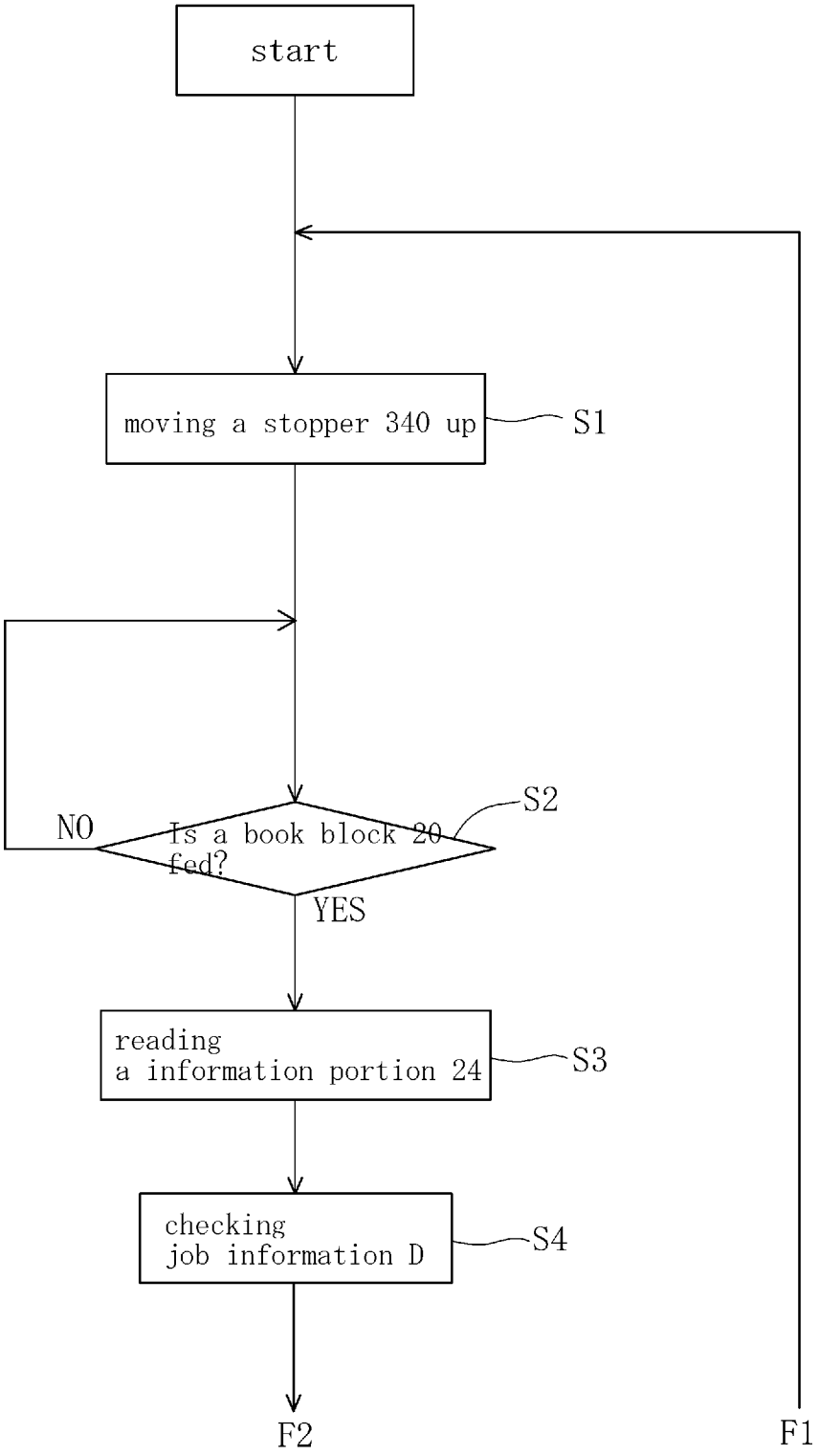

[Fig. 5]
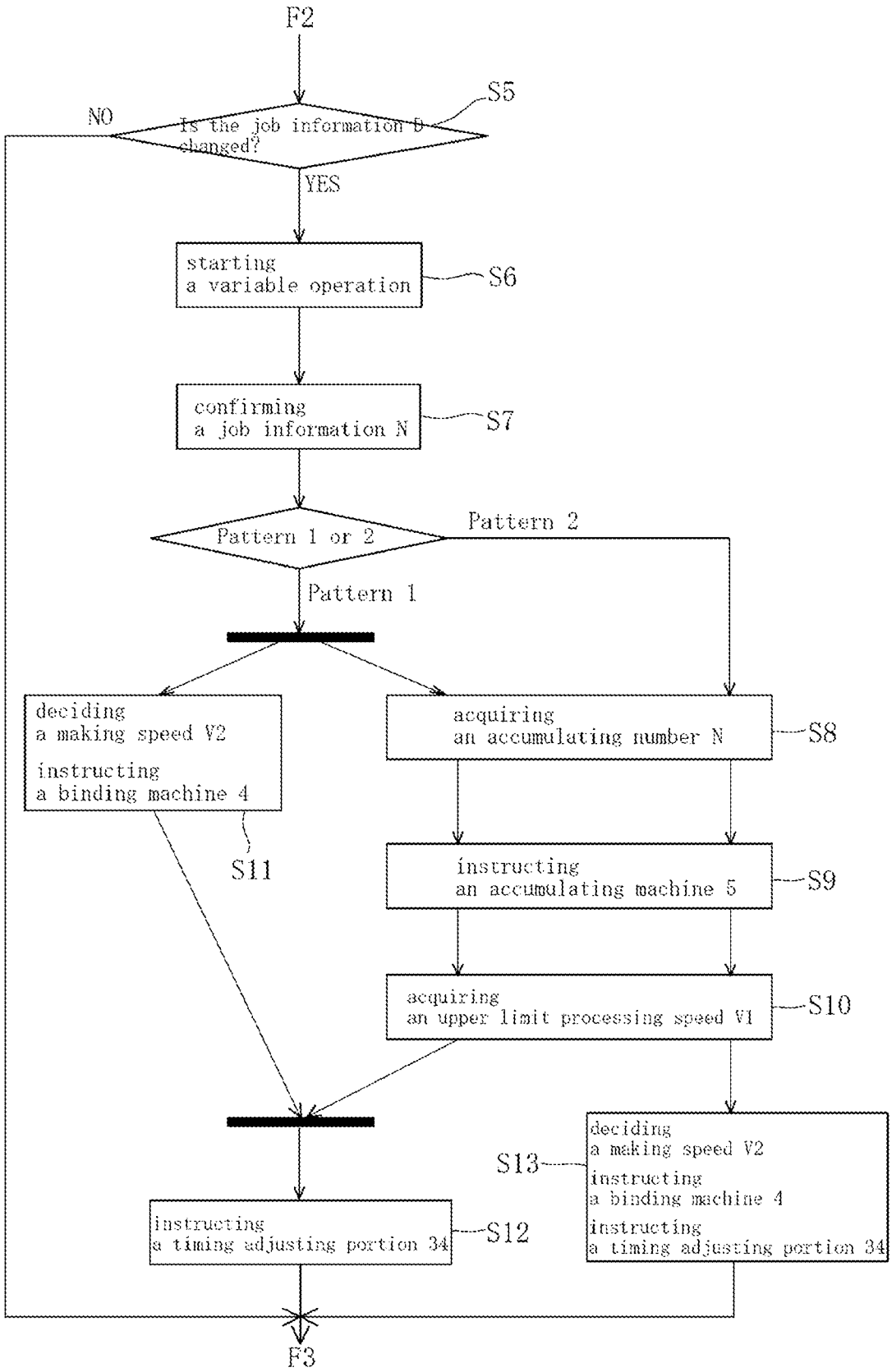

[Fig. 6]
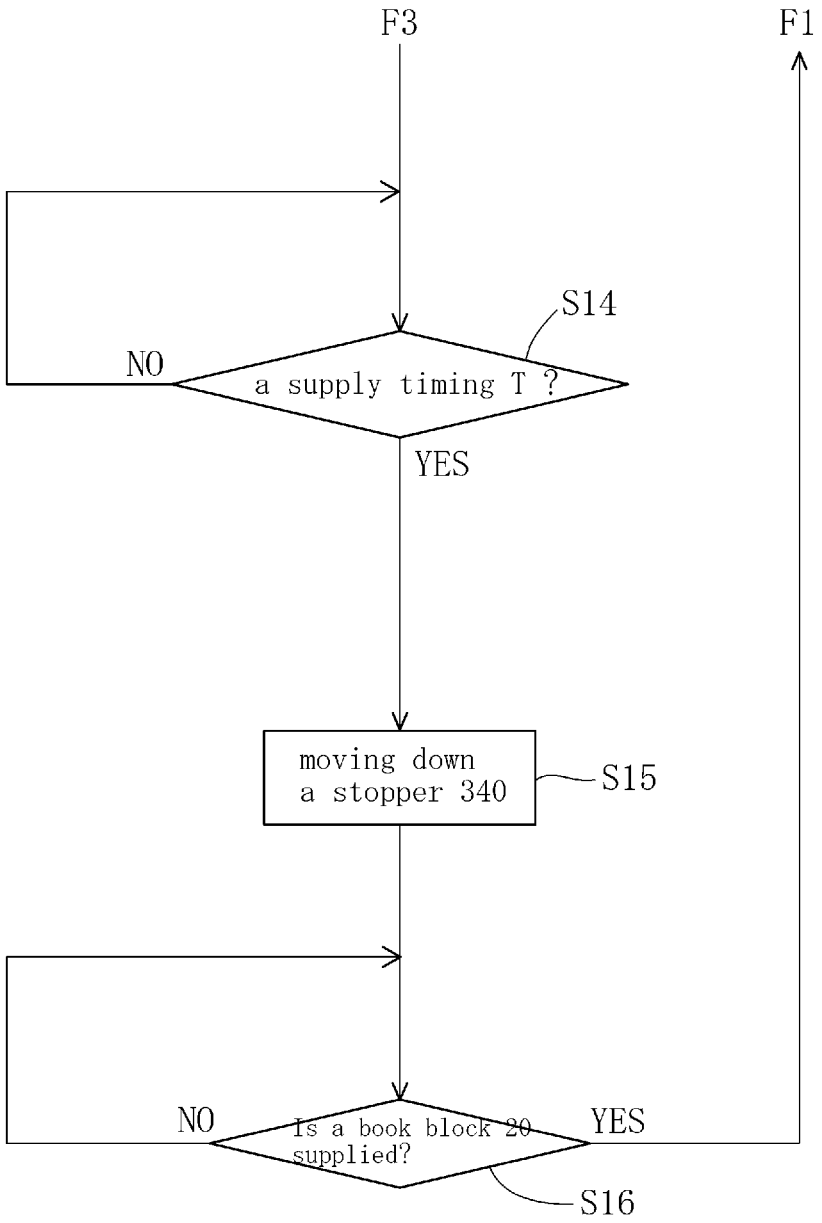

BOOK BINDING SYSTEM

TECHNICAL FIELD OF THE APPLICATION

The present application relates to a book binding system which comprises a book block supplying machine configured to supply a book block, a book binding machine configured to attach a cover to the book block so as to make a bound material, an accumulating machine configured to accumulate the bound materials, a trimming machine configured to trim the edges of the bound material.

BACKGROUND OF THE APPLICATION

A book binding system is configured to make a book block from a plurality of sheets, then attach a cover to the book block so as to make a bound material, and then trim the edges of the bound material so as to make a product. As shown in FIG. 1, the book binding system comprises a folding machine 1, a book block making machine 2, a book block supplying machine 3, a book binding machine 4, an accumulating machine 5 and a trimming machine 6.

The folding machine 1 is configured to accordion-fold (mountain fold and valley fold) the sheet fed from a sheet feeding tray, a printer or an unwinder 8, and to make quires, see Patent Document 1 and so on. The book block making machine 2 is configured to accumulate a predetermined number of the quires made by the folding machine 1 so as to make the book block 20, see Patent Document 2 and so on.

The book block supplying machine 3 is configured to feed the book block 20 made by the book block making machine 2 toward the book binding machine 4, see Patent Document 3 and so on. The book binding machine 4 is configured to receive the book block 20 fed from the book block supplying machine 3, and then attach a cover 21 to the book block 20 so as to make the bound material 22, see Patent Document 4 and so on.

The accumulating machine 5 is configured to accumulate a predetermined number of the bound material 22 made by the book binding machine 4, see Patent Document 5 and so on. The trimming machine 6 is configured to receive the bound material 22 fed from the accumulating machine 5, and then trim the edges of the bound material 22 so as to make the product 23, see Patent Document 6 and so on. As shown in FIG. 1, the book binding system comprises a cool conveying machine 7 disposed between the accumulating machine 5 and the trimming machine 6. However, the cool conveying machine 7 may not be provided so that the accumulating machine 5 and the trimming machine 6 can be directly connected with each other.

By the way, the demand of the variable printing by using a digital printer is recently increasing. As a result, the book binding system is needed to be configured to make the products 23 having various sizes per one or a few books. Here, the accumulating machine 5 can only accumulate the bound materials 22 having the same size. Therefore, there is a condition that the accumulating machine 5 has to accumulate the bound materials 22 and feed them toward the trimming machine 6 per one or a few books. And, there is also another condition that each of the processing speeds of the book binding machine 4 and the trimming machine 6 is different from each other. Then, the processing speeds of the accumulating machine 5 and the trimming machine 6 are often slower than the processing speed of the book binding machine 4. Consequently, there is a problem that a conventional book binding system has low productivity to meet the variable printing and these predetermined conditions.

Patent Document 1: PCT 2013/161048 A
Patent Document 2: PCT 2016/207977 A
Patent Document 3: JP 2013-169798 A
Patent Document 4: JP 2010-274501 A
Patent Document 5: JP 2014-54731 A
Patent Document 6: PCT 2013/179380 A

Problems to be Solved by the Application

It is an object of the present application to provide a book binding system configured to achieve high productivity even when meeting the variable printing and these predetermined conditions.

Solution to the Problems

In order to achieve the objects, the first present application provides a book binding system, comprising:

- a book block supplying machine configured to supply a book block;
- a book binding machine configured to attach a cover to the book block so as to make a bound material;
- an accumulating machine configured to accumulate the bound materials made by the book binding machine;
- a trimming machine configured to trim edges of the bound material fed from the accumulating machine; and
- a controller connected with the book block supplying machine, the book binding machine, the accumulating machine and the trimming machine, wherein the book block supplying machine comprises:

- a reader configured to read job information from an information portion printed on the book block; and
- a timing adjusting portion configured to adjust a supply of the book block in such a way that the book block is fed toward the book binding machine at a supply timing, wherein the job information includes:

- an information regarding an accumulating number of the bound material accumulated by the accumulating machine; and
- an information regarding a making speed at which the book binding machine makes the bound material, wherein the controller comprises:

- a job information acquisition portion configured to acquire the job information from the reader;
- an upper limit processing speed acquisition portion configured to acquire an upper limit processing speed at which the trimming machine or the accumulating machine processes the bound material;
- a making speed decision portion configured to adopt and decide the making speed;
- a making speed instruction portion configured to instruct the book binding machine to make the bound material at the making speed;
- a timing decision portion configured to decide the supply timing based on the making speed, the upper limit processing speed and the accumulating number; and
- a timing instruction portion configured to instruct the timing adjusting portion to supply the book block at the supply timing, and wherein the upper limit processing speed is composed of a first upper limit speed or a second upper limit speed, the first upper limit speed is composed of an upper limit speed at which the trimming machine trims the bound material, the second upper limit speed is composed of an upper limit speed at which the accumulating machine feeds the bound material, and a slower one of the first and second upper limit speeds is adopted as the upper limit processing speed.

The second present application provides a book binding system, comprising:

a book block supplying machine configured to supply a book block;

a book binding machine configured to attach a cover to the book block so as to make a bound material;

an accumulating machine configured to accumulate the bound materials made by the book binding machine;

a trimming machine configured to trim edges of the bound material fed from the accumulating machine; and a controller connected with the book block supplying machine, the book binding machine, the accumulating machine and the trimming machine, wherein the book block supplying machine comprises:

a reader configured to read job information from an information portion printed on the book block; and a timing adjusting portion configured to adjust a supply of the book block in such a way that the book block is fed toward the book binding machine at a supply timing, wherein the job information includes:

an information regarding an accumulating number of the bound material accumulated by the accumulating machine, wherein the controller comprises:

a job information acquisition portion configured to acquire the job information from the reader;

an upper limit processing speed acquisition portion configured to acquire an upper limit processing speed at which the trimming machine or the accumulating machine processes the bound material;

a making speed decision portion configured to decide the making speed at which the book binding machine makes the bound material, based on the accumulating number and the upper limit processing speed;

a making speed instruction portion configured to instruct the book binding machine to make the bound material at the making speed;

a timing decision portion configured to decide the supply timing based on the making speed; and a timing instruction portion configured to instruct the timing adjusting portion to supply the book block at the supply timing, and wherein the upper limit processing speed is composed of a first upper limit speed or a second upper limit speed, the first upper limit speed is composed of an upper limit speed at which the trimming machine trims the bound material, the second upper limit speed is composed of an upper limit speed at which the accumulating machine feeds the bound material, and a slower one of the first and second upper limit speeds is adopted as the upper limit processing speed.

According to further embodiment of the present application, wherein the book block supplying machine comprises:

a first feeding portion configured to successively feed the book block toward the book binding machine; and a second feeding portion configured to successively feed the book block toward the first feeding portion, wherein the timing adjusting portion is disposed between the first and second feeding portions, and comprises a stopper configured to stop feeding the book block from the second feeding portion toward the first feeding portion.

According to further embodiment of the present application, wherein the book binding machine comprises:

a third feeding portion configured to successively feed the book block fed from the book block supplying machine; and a processing portion configured to perform a milling process, a gluing process and a cover attachment process while the book blocks are successively fed by the third feeding portion, wherein a feeding speed of the third feeding portion is coincident with the making speed.

According to further embodiment of the present application, wherein the third feeding portion comprises a plurality of clampers successively fed, each of the clampers is configured to clamp the book block fed from the book block supplying machine, the timing adjusting portion is configured to supply the book blocks of a second number to the clampers of a first number, and the first number is more than the second number.

Effect of the Application

The book binding system according to the present application achieves high productivity even when meeting the variable printing and these predetermined conditions.

BRIEF DESCRIPTION OF THE DRAWINGS

FIG. 1 is a plan view showing a book binding system.

FIG. 2 is a plan view showing an inside of the book binding machine.

FIG. 3 is an explanatory view for describing a controlling machine.

FIG. 4 is a flowchart showing a process of the book binding system.

FIG. 5 is a subsequent flowchart to FIG. 4.

FIG. 6 is a subsequent flowchart to FIG. 5.

DETAILED EXPLANATION OF THE EMBODIMENTS

A book binding system according to the present application will be explained hereinbelow with reference to the figures.

[Structure]

The structure of the book binding system will be explained.

As shown in FIG. 1, the book binding system comprises a folding machine 1, a book block making machine 2, a book block supplying machine 3, a book binding machine 4, an accumulating machine 5 and a trimming machine 6. The book binding system is configured to make a book block 20 from a plurality of sheets, then attach a cover 21 to the book block 20 so as to make a bound material 22, and then trim the edges of the bound material 22 so as to make a product 23.

The folding machine 1 is configured to accordion-fold (mountain fold and valley fold) the sheet (not shown) fed from a sheet feeding tray, a printer or an unwinder 8, and to make a quire. The concrete structure of the folding machine 1 is described in, for example, Patent Document 1. The book block making machine 2 is configured to accumulate a predetermined number of the quires made by the folding machine 1 so as to make the book block 20. The concrete structure of the book block making machine 2 is described in, for example, Patent Document 2.

The book block supplying machine 3 is configured to feed the book block 20 made by the book block making machine 2 toward the book binding machine 4. The concrete structure of the book block supplying machine 3 is described in, for example, Patent Document 3. The book binding machine 4 is configured to receive the book block 20 fed from the book block supplying machine 3, and then attach the cover 21 to the book block 20 so as to make the bound material 22. The concrete structure of the book binding machine 4 is described in, for example, Patent Document 4.

The accumulating machine 5 is configured to accumulate a predetermined number of the bound material 22 made by the book binding machine 4. The concrete structure of the accumulating machine 5 is described in, for example, Patent Document 5. The trimming machine 6 is configured to receive the bound material 22 fed from the accumulating machine 5, and then trim the edges of the bound material 22 so as to make the product 23. The concrete structure of the trimming machine 6 is described in, for example, Patent Document 6.

As shown in FIG. 1, the book binding system comprises a cool conveying machine 7 between the accumulating machine 5 and the trimming machine 6. The concrete structure of the cool conveying machine 7 is described in, for example, Patent Document 5. However, the cool conveying machine 7 may not be provided so that the accumulating machine 6 and the trimming machine 6 can be directly connected with each other.

The book block 20 has an information portion 24 printed on its surface. The information portion 24 is composed of, for example, barcode. The information portion 24 includes a predetermined job information D. The book block supplying machine 3 comprises a reader 33 to read the information portion 24. The reader 33 is composed of, for example, a barcode reader.

The job information D includes a first information D1 regarding an accumulating number N of the bound material 22 to be accumulated by the accumulating machine 5. The job information D includes a second information D2 regarding the making speed V2 at which the book binding machine 4 makes the bound material 22. As described later, the job information D may not include the second information D2 regarding the making speed V2.

The book block supplying machine 3 comprises a first feeding portion 31 that successively feeds the book block 20 toward the book binding machine 4, and a second feeding portion 32 that successively feeds the book block 20 toward the first feeding portion 31. The first feeding portion 31 is configured to clamp and feed the book block 20 fed from the second feeding portion 32, and then discharge the book block 20 toward the book binding machine 4.

The first feeding portion 31 comprises a plurality of clampers 311 that clamps the book blocks 20, and a rotating chain portion 310 that feeds the clampers 311 successively. The rotating chain portion 310 rotates the clampers 311 disposed at a predetermined interval. The second feeding portion 32 is configured to feed successively the book block fed from the book block making machine 2. The second feeding portion 32 comprises a belt conveyer 320 that feeds the book block 20. The book block 20 is put on the belt conveyer 320.

The book block supplying machine 3 comprises a timing adjusting portion 34 that adjusts the supply of the book block 20 in such a way that the book block 20 is fed toward the book binding machine 4 at a supply timing T. The timing adjusting portion 34 is disposed between the first and second feeding portions 31 and 32, and comprises a stopper 340 that stops feeding the book block 20 from the second feeding portion 32 toward the first feeding portion 31.

The stopper 340 moves up and down between positions upper and lower than an upper surface of the belt conveyer 320. The stopper 340 moves up toward the position upper than the upper surface of the belt conveyer 320 when stopping the feed of the book block 20, while it moves down toward the position lower than the upper surface of the belt conveyer 320 when not stopping the feed of the book block 20.

Thus, a plurality of the book blocks 20 may be remained on the belt conveyer 320 when the book blocks 20 are fed from the book block making machine 2 while the book blocks are stopped by the stopper 340. Therefore, the belt conveyer 320 has a predetermined length to serve as a buffer for the book blocks 20.

As shown in FIG. 2, the book binding machine 4 comprises a third feeding portion configured to feed the book block 20 fed from the book block supplying machine 3 successively. The book binding machine 4 comprises a processing portion 42 configured to perform a milling process, a gluing process and a cover attachment process while the book blocks 20 are fed by the third feeding portion 41 successively.

The third feeding portion 41 comprises a plurality of clampers 411 that clamps the book blocks 20, and a rotating chain portion 410 that feeds the clampers 411 successively. The rotating chain portion 410 rotates a plurality of the clampers 411 disposed at a predetermined interval.

The processing portion 42 comprises an entrance portion 421. The entrance portion 421 is configured to make the clampers 411 clamp the book blocks 20 fed from the book block supplying machine 3. The processing portion 42 comprises a milling portion 422 that performs the milling process. The milling portion 422 comprises milling blades (not shown) that trim the back surface of the book block 20 clamped by the clampers 411.

The processing portion 42 comprises a gluing portion 423 that performs the gluing process. The gluing portion 423 is configured to apply glue to the back surface of the book block 20 trimmed by the milling portion 422. The processing portion 42 comprises a cover supplying portion 424. The cover supplying portion 424 is configured to supply the cover 21 to the book block 20 having the glue. The processing portion 42 comprises a fitting portion 425. The fitting portion 425 is configured to feed the cover 21 from the cover supplying portion 424, and attach the cover 21 to the back surface of the book block 20 clamped by the clamper 41.

The processing portion 42 comprises a nipping portion 426 that performs the cover attachment process. The nipping portion 426 is configured to fold the cover 21 attached to the book block 20 from the both sides of the cover 21, and fit the cover 21 along the book block 20. The processing portion 42 comprises a discharging portion 427. The discharging portion 427 is configured to open the clamper 411 so as to release and discharge the book block 20 having the cover 21.

As described above, the book binding machine 4 is configured to perform the milling process, the gluing process and the cover attachment process so as to make the bound material 22 while the book blocks 20 are fed by the third feeding portion 41 successively. Thus, the making speed V2 at which the bound material 22 is made is coincident with a feeding speed at which the third feeding portion 41 feeds the book block 20.

As shown in FIG. 3, the book binding system comprises a controller 10. The controller 10 comprises a job information acquisition portion 100. The job information acquisition portion 100 is configured to acquire the job information D from the reader 33. The controller 10 comprises an upper limit processing speed acquisition portion 101. The upper limit processing speed acquisition portion 101 is configured to acquire an upper limit processing speed V1 at which the trimming machine 6 or the accumulating machine 5 processes the bound material 22. In the same way, the upper limit processing speed V1 is composed of a first upper limit speed or a second upper limit speed. Here, the first upper limit speed is composed of an upper limit speed at which the trimming machine 6 trims the bound material 22, while the second upper limit speed is composed of an upper limit speed at which the accumulating machine 5 feeds the bound material 22. Further, the slower one of the first and second upper limit speeds is adopted as the upper limit processing speed V1.

The controller 10 comprises a making speed decision portion 102. The making speed decision portion 102 is configured to decide the making speed V2 at which the bound material 22 is made, based on the accumulating number N and the upper limit processing speed V1. The making speed decision portion 102 may adopt and determine the making speed V2 when the job information D includes the second information D2 regarding the making speed V2.

The controller 10 comprises a making speed instruction portion 103. The making speed instruction portion 103 is configured to instruct the book binding machine 4 to make the bound material 22 at the making speed V2. The making speed instruction portion 103 may instruct the book binding machine 4 to make the bound material 22 at the making speed V2 when the job information D includes the information D2 regarding the making speed V2.

The controller 10 comprises a timing decision portion 104. The timing decision portion 104 is configured to decide the supply timing T based on the accumulating number N and the upper limit processing speed V1. As described below, the timing decision portion 104 may decide the supply timing T based on the making speed V2.

The controller 10 comprises a timing instruction portion 105. The timing instruction portion 105 is configured to instruct the timing adjusting portion 34 to supply the book block 20 at the supply timing T. The timing adjusting portion 34 is configured to move the stopper 340 up and down at the supply timing T based on the instruction.

Process

The process of the book binding system will be explained.

As shown in FIG. 4, the stopper 340 moves up so as to stop the book block 20 fed by the second feeding portion 32 (step S1). Then, a sensor (not shown) detects whether or not the book block 20 is fed toward a predetermined position of the second feeding portion 32 (step S2). The book binding system repeats the step S2 when the book block 20 is not fed toward the predetermined position. On the other hand, the reader 33 reads the information portion 24 of the book block 20 when the book block 20 is fed toward the predetermined position (step S3).

Then, the job information acquisition portion 100 acquires the job information D (D1, D2) included in the information portion 24. The job information acquisition portion 100 checks the job information D against a job table pre-memorized in a memory (not shown) of the controller 10 or an external device so as to extract a concrete numeral number of the accumulating number N (the information D1) and/or the making speed V2 (the second information D2) (step S4).

As shown in FIG. 5, the job information acquisition portion 100 detects whether or not the job information D is changed (step S5). In the same way, the job information acquisition portion 100 compares between two of the job information D acquired last time and this time so as to detect whether or not each of the job information D is different from each other.

The book binding system goes forward to a step S14 described later when the job information D is not changed. On the other hand, the book binding system starts a variable operation (step S6) when the job information D is changed (step S6). The job information acquisition portion 100 confirms the extracted accumulating number N (the information D1) and/or the making speed V2 (the second information D2) (step S7).

<Pattern 1>

Pattern 1 will be explained.

In the pattern 1, the job information D includes the first information D1 regarding the accumulating number N and the second information D2 regarding the making speed V2. In the same way, the book binding system goes forward to steps S8 to S12 described later when the job information D includes the second information D2 regarding the making speed V2.

The job information acquisition portion 100 acquires the accumulating number N (step S8). The job information acquisition portion 100 instructs the accumulating machine 5 to accumulate the bound materials 22 in the accumulating number N (step S9). The upper limit processing speed acquisition portion 101 acquires the upper limit processing speed V1 at which the trimming machine 6 processes the bound material 22 (step S10). As described above, the slower one of the first upper limit speed of the trimming machine 6 and the second upper limit speed of the accumulating machine 5 is adopted as the upper limit processing speed V1.

The making speed decision portion 102 adopts and decides the making speed V2 from the second information D2. The making speed instruction portion 103 instructs the book binding machine 4 to make the bound material 22 at the making speed V2 (step S11).

The timing decision portion 104 decides the supply timing T based on the making speed V2, the upper limit processing speed V1 and the accumulating number N. The timing instruction portion 105 instructs the timing adjusting portion 34 to supply the book block 20 at the supply timing T (step S12).

The step S12 will be explained in detail.

At first, productivity E1 of the trimming machine 6 is calculated by a following equation (1).

$$E1\ (\text{the productivity}) = V1\ (\text{the upper limit processing speed}) \times N\ (\text{the accumulating number}) \qquad \text{equation (1)}$$

Next, the supply timing T, at which the book block supplying machine 3 feeds the book block 20 toward the book binding machine 4, is decided in such a way that a following equation (2) is met. In consideration of productivity, the supply timing T is decided in such a way that the following equation (2) is met and a production rate E2 of the book block supplying machine 3 becomes the highest.

$$E2\ (\text{the production rate}) \leq E1\ (\text{the productivity}) \div V2\ (\text{the making speed}) \qquad \text{equation (2)}$$

<Pattern 2>

Pattern 2 will be explained.

In the pattern 2, the job information D includes the first information D1 regarding the accumulating number N. In the same way, the book binding system goes forward to steps S8 to S10, S13 described later when the job information D does not include the second information D2 regarding the making speed V2.

The job information acquisition portion 100 acquires the accumulating number N (step S8). The job information acquisition portion 100 instructs the accumulating machine 5 to accumulate the bound materials 22 in the accumulating number N (step S9). The upper limit processing speed acquisition portion 101 acquires the upper limit processing speed V1 at which the trimming machine 6 processes the bound material 22 (step S10). As described above, the slower one of the first upper limit speed of the trimming machine 6 and the second upper limit speed of the accumulating machine 5 is adopted as the upper limit processing speed V1.

The making speed decision portion 102 decides the making speed V2 at which the book binding machine 4 makes the bound material 22, based on the accumulating number N and the upper limit processing speed V1. Then, the making speed instruction portion 103 instructs the book binding machine 4 to make the bound material 22 at the making speed V2. Then, the timing decision portion 104 decides the supply timing T based on the making speed V2. And then, the timing instruction portion 105 instructs the timing adjusting portion 34 to supply the book block 20 at the supply timing T (step S13).

The step S13 will be explained in detail.

At first, the productivity E1 of the trimming machine 6 is calculated by the above equation (1).

Then, the making speed V2 is decided in such a way that the making speed V2 becomes lower than the productivity E1 (the making speed V2≤the productivity E1). In consideration of productivity, the making speed V2 is decided in such a way that the making speed V2 becomes lower than the productivity E1 (the making speed V2 the productivity E1) and the making speed V2 becomes the fastest. Upper and lower limits regarding the making speed V2 may be set depending on the book binding machine 4.

As shown in FIG. 6, the timing adjusting portion 34 determines whether or not the present time is the supply timing T (step S14). The book binding system repeats the step S14 when the present time is not the supply timing T. On the other hand, the book binding system goes forward to a following step S15 when the present time is the supply timing T.

The timing adjusting portion 34 moves the stopper 340 down so as to supply the book block 20 toward the first feeding portion 31 at the supply timing T (step S15). The book binding system returns to the step S1 after the book block 20 is supplied toward the first feeding portion 31 (step S16).

First Embodiment

With reference to a following Table 1, a first embodiment will be explained. As described above, the slower one of the first upper limit speed of the trimming machine 6 and the second upper limit speed of the accumulating machine 5 is adopted as the upper limit processing speed V1. However, in this embodiment, the upper limit processing speed V1 is the first upper limit speed of the trimming machine 6.

TABLE 1

| Job No. | making speed V2 [cycle/hour] | upper limit processing speed V1 [cycle/hour] | accumulating number N [book] | productivity E1 | supply timing T |
|---|---|---|---|---|---|
| 1-1 | 3000 | 600 | 3 | 1800 | 3 books supplied to 5 clampers |
| 1-2 | 3000 | | 2 | 1200 | 2 books supplied to 5 clampers |
| 1-3 | 3000 | | 1 | 600 | 1 book supplied to 5 clampers |

Job No. 1-1

The above pattern 1 will be performed.

The accumulating number N=3 and the making speed V2=3000 included in the job information D are acquired from the reader 33. The upper limit processing speed V1=600 is acquired from the trimming machine 6.

The productivity E1=1800 (=600×3) is calculated by the above equation (1).

The production rate E2≤0.6 (=1800÷3000) is calculated by the above equation (2). Thus, the supply timing T is decided in such a way that the production rate E2 becomes the highest. In this case, the three book blocks 20 (the three is defined as a second number) are supplied toward the five clampers 411 (the five is defined as a first number) of the book binding machine 4 at the supply timing T (3÷5=0.6).

Job No. 1-2

The above pattern 1 will be performed.

The accumulating number N=2 and the making speed V2=3000 included in the job information D are acquired from the reader 33. The upper limit processing speed V1=600 is acquired from the trimming machine 6.

The productivity E1=1200 (=600×2) is calculated by the above equation (1).

The production rate E2≤0.4 (=1200÷3000) is calculated from the above equation (2). Thus, the supply timing T is decided in such a way that the production rate E2 becomes the highest. In this case, the two book blocks 20 (the two is defined as the second number) are supplied toward the five clampers 411 (the five is defined as the first number) of the book binding machine 4 at the supply timing T (2÷5=0.4).

Job No. 1-3

The above pattern 1 will be performed.

The accumulating number N=1 and the making speed V2=3000 included in the job information D are acquired from the reader 33.

The productivity E1=600 (=600×1) is calculated by the above equation (1).

The production rate E2≤0.2 (=600÷3000) is calculated from the above equation (2). Thus, the supply timing T is decided in such a way that the production rate E2 becomes the highest. In this case, the one book block 20 (the one is defined as the second number) is supplied toward the five clampers 411 (the five is defined as the first number) of the book binding machine 4 at the supply timing T (1÷5=0.2).

Second Embodiment

With reference to a following Table 2, a second embodiment will be explained. As described above, the slower one of the first upper limit speed of the trimming machine 6 and the second upper limit speed of the accumulating machine 5 is adopted as the upper limit processing speed V1. However, in this embodiment, the upper limit processing speed V1 is the first upper limit speed of the trimming machine 6.

TABLE 2

| Job No. | making speed V2 [cycle/hour] | upper limit processing speed V1 [cycle/hour] | accumulating number N [book] | productivity E1 | supply timing T |
|---|---|---|---|---|---|
| 2-1 | 2800 | 700 | 4 | 2800 | books supplied to all clampers |
| 2-2 | 2000 | | 3 | 2100 | books supplied to all clampers |
| 2-3 | 1000 | | 1 | 700 | 7 books supplied to 10 clampers |

Job No. 2-1

The above pattern 2 will be performed.

The accumulating number N=4 included in the job information D is acquired from the reader 33. The upper limit processing speed V1=700 is acquired from the trimming machine 6.

The productivity E1=2800 (=700×4) is calculated by the above equation (1).

The making speed V2=2800 is decided in such a way that the making speed V2≤the productivity E1=2800 is made and the making speed V2 becomes the fastest. In this case, the book blocks 20 are supplied toward all of the clampers 411 of the book binding machine 4.

Job No. 2-2

The above pattern 2 will be performed.

The accumulating number N=3 included in the job information D is acquired from the reader 33. The upper limit processing speed V1=700 is acquired from the trimming machine 6.

The productivity E1=2100 (=700×3) is calculated by the above equation (1).

The making speed V2=2000 is decided in such a way that the making speed V2 the productivity E1=2100 is made. In this case, the book blocks 20 are supplied toward all of the clampers 411 of the book binding machine 4.

Job No. 2-3

The above pattern 1 will be performed.

The accumulating number N=1 and the making speed V2=1000 (the lower limit of the making speed V2 in this embodiment) included in the job information D are acquired from the reader 33. The upper limit processing speed V1=700 is acquired from the trimming machine 6.

The productivity E1=700 (=700×1) is calculated by the above equation (1).

The production rate E2≥0.2 (=700±1000) is calculated from the above equation (2). Thus, the supply timing T is decided in such a way that the production rate E2 becomes the highest. In this case, the seven book blocks 20 (the seven is defined as the second number) are supplied toward the ten clampers 411 (the ten is defined as the first number) of the book binding machine 4 at the supply timing T (7÷10=0.7).

Some preferable embodiments of the present application are explained, but the structural features of the present application are not limited to these embodiments.

EXPLANATION OF CODES

3: book block supplying machine
31: first feeding portion
32: second feeding portion
33: reader
34: timing adjusting portion
340: stopper
4: book binding machine
41: third feeding portion
411: clamper
42: processing portion
5: accumulating machine
6: trimming machine
10: controller
20: book block
21: cover
22: bound material
23: product
24: information portion
100: job information acquisition portion
101: upper limit processing speed acquisition portion
102: making speed decision portion
103: making speed instruction portion
104: timing decision portion
105: timing instruction portion
D: job information
D1: first information regarding an accumulating number
D2: second information regarding a making speed
N: accumulating number
V1: upper limit processing speed
V2: making speed
T: supply timing

What is claimed is:

1. A book binding system, comprising:

a book block supplying machine configured to supply a book block;

a book binding machine configured to receive the book block fed from the book block supplying machine and attach a cover to the book block so as to make a bound material;

an accumulating machine configured to accumulate the bound material made by the book binding machine;

a trimming machine configured to receive the bound material fed from the accumulating machine and trim edges of the bound material; and a controller connected with the book block supplying machine, the book binding machine, the accumulating machine and the trimming machine, wherein the book block supplying machine comprises:

a reader configured to read job information from an information portion printed on the book block; and a timing adjusting portion configured to adjust a supply of the book block in such a way that the book block is fed toward the book binding machine at a supply timing, wherein the job information includes:

an information regarding an accumulating number of the bound material accumulated by the accumulating machine; and an information regarding a making speed at which the book binding machine makes the bound material, wherein the controller comprises:

a job information acquisition portion configured to acquire the job information from the reader;

an upper limit processing speed acquisition portion configured to acquire an upper limit processing speed at which the trimming machine or the accumulating machine processes the bound material;

a making speed decision portion configured to adopt and decide the making speed;

a making speed instruction portion configured to instruct the book binding machine to make the bound material at the making speed;

a timing decision portion configured to decide the supply timing based on the making speed, the upper limit processing speed and the accumulating number; and a timing instruction portion configured to instruct the timing adjusting portion to supply the book block at the supply timing, and wherein the upper limit processing speed is composed of a first upper limit speed or a second upper limit speed, the first upper limit speed is composed of an upper limit speed at which the trimming machine trims the bound material, the second upper limit speed is composed of an upper limit speed at which the accumulating machine feeds the bound material, and a slower one of the first and second upper limit speeds is adopted as the upper limit processing speed.

2. The book binding system according to claim 1, wherein the book block supplying machine comprises:

a first feeding portion configured to successively feed the book block toward the book binding machine; and a second feeding portion configured to successively feed the book block toward the first feeding portion, wherein the timing adjusting portion is disposed between the first and second feeding portions, and comprises a stopper configured to stop feeding the book block from the second feeding portion toward the first feeding portion.

3. The book binding system according to claim 2, wherein the book binding machine comprises:

a third feeding portion configured to successively feed the book block fed from the book block supplying machine; and a processing portion configured to perform a milling process, a gluing process and a cover attachment process while the book blocks are successively fed by the third feeding portion, wherein a feeding speed of the third feeding portion is coincident with the making speed.

4. The book binding system according to claim 1, wherein the book binding machine comprises:

a third feeding portion configured to successively feed the book block fed from the book block supplying machine; and a processing portion configured to perform a milling process, a gluing process and a cover attachment process while the book blocks are successively fed by the third feeding portion, wherein a feeding speed of the third feeding portion is coincident with the making speed.

5. The book binding system according to claim 4, wherein the third feeding portion comprises a plurality of clampers successively fed, each of the clampers is configured to clamp the book block fed from the book block supplying machine, the timing adjusting portion is configured to supply a second number of the book blocks to a first number of the clampers, wherein the first number is greater than the second number.

6. The book binding system according to claim 4, wherein the book binding machine comprises:

a third feeding portion configured to successively feed the book block fed from the book block supplying machine; and a processing portion configured to perform a milling process, a gluing process and a cover attachment process while the book blocks are successively fed by the third feeding portion, wherein a feeding speed of the third feeding portion is coincident with the making speed.

7. A book binding system, comprising:

a book block supplying machine configured to supply a book block;

a book binding machine configured to receive the book block fed from the book block supplying machine and attach a cover to the book block so as to make a bound material;

an accumulating machine configured to accumulate the bound material made by the book binding machine;

a trimming machine configured to receive the bound material fed from the accumulating machine and trim edges of the bound material; and a controller connected with the book block supplying machine, the book binding machine, the accumulating machine and the trimming machine, wherein the book block supplying machine comprises:

a reader configured to read job information from an information portion printed on the book block; and a timing adjusting portion configured to adjust a supply of the book block in such a way that the book block is fed toward the book binding machine at a supply timing, wherein the job information includes:

an information regarding an accumulating number of the bound material accumulated by the accumulating machine, wherein the controller comprises:

a job information acquisition portion configured to acquire the job information from the reader;

an upper limit processing speed acquisition portion configured to acquire an upper limit processing speed at which the trimming machine or the accumulating machine processes the bound material;

a making speed decision portion configured to decide the making speed at which the book binding machine makes the bound material, based on the accumulating number and the upper limit processing speed;

a making speed instruction portion configured to instruct the book binding machine to make the bound material at the making speed;

a timing decision portion configured to decide the supply timing based on the making speed; and a timing instruction portion configured to instruct the timing adjusting portion to supply the book block at the supply timing, and wherein the upper limit processing speed is composed of a first upper limit speed or a second upper limit speed, the first upper limit speed is composed of an upper limit speed at which the trimming machine trims the bound material, the second upper limit speed is composed of an upper limit speed at which the accumulating machine feeds the bound material, and a slower one of the first and second upper limit speeds is adopted as the upper limit processing speed.

8. The book binding system according to claim 7, wherein the book block supplying machine comprises:

a first feeding portion configured to successively feed the book block toward the book binding machine; and a second feeding portion configured to successively feed the book block toward the first feeding portion, wherein the timing adjusting portion is disposed between the first and second feeding portions, and comprises a stopper configured to stop feeding the book block from the second feeding portion toward the first feeding portion.

9. The book binding system according to claim 7, wherein the book binding machine comprises:

a third feeding portion configured to successively feed the book block fed from the book block supplying machine; and a processing portion configured to perform a milling process, a gluing process and a cover attachment process while the book blocks are successively fed by the third feeding portion, wherein a feeding speed of the third feeding portion is coincident with the making speed.

* * * * *